United States Patent [19]

Lussana et al.

[11] 4,447,285

[45] May 8, 1984

[54] DEVICE FOR HOLDING PAPER CLOSE AGAINST A CORRUGATING ROLLER IN A CORRUGATED BOARD-MAKING MACHINE

[75] Inventors: Riccardo Lussana, Casatenovo; Fabrizio Massenzana, Arcore, both of Italy

[73] Assignee: Vitino Massenzana S.R.L., Arcore, Italy

[21] Appl. No.: 537,522

[22] Filed: Sep. 30, 1983

[30] Foreign Application Priority Data

Dec. 29, 1982 [IT] Italy ..... 25025 A/82

[51] Int. Cl.[3] ..... B31F 1/28

[52] U.S. Cl. ..... 156/473; 425/369

[58] Field of Search ..... 156/470–473; 425/369, 388, 396

[56] References Cited

U.S. PATENT DOCUMENTS

| | | | |
|---|---|---|---|
| 2,068,155 | 1/1937 | Swift | 156/473 |
| 4,177,102 | 12/1979 | Tokuno | 156/472 |
| 4,251,313 | 2/1981 | Abe | 156/472 X |
| 4,270,969 | 6/1981 | Kelley | 156/473 |
| 4,368,094 | 1/1983 | Mayer et al. | 156/473 X |
| 4,381,212 | 4/1983 | Roberts | 156/473 |

*Primary Examiner*—David A. Simmons

*Attorney, Agent, or Firm*—Robert E. Knechtel

[57] ABSTRACT

The invention is related to the technical field of cardboard-making machines, and in particular it concerns a device for holding paper close against a corrugating roller in a corrugated board-making machine.

The technical problem to be solved is that of providing such a device, which, while being simple and applicable to virtually all of the corrugated board-making machines, can attain an efficiency level affording a significant increase of the machine production rate and quality.

The problem has been solved by providing a device which comprises suction members having a number of flattened suction ports to fit at least in part in the indentations of a corrugating roller and being rigid with holders carried slidably on bars which extend parallel to the corrugating roller, said holders being guided along said bars by locating elements made rigid with the holders and inserted into said indentations in substantially direct contact relationship with the corrugating roller.

7 Claims, 5 Drawing Figures

DEVICE FOR HOLDING PAPER CLOSE AGAINST A CORRUGATING ROLLER IN A CORRUGATED BOARD-MAKING MACHINE

BACKGROUND OF THE INVENTION

This invention relates to a device for holding paper close against a corrugating roller in a corrugated board-making machine.

As it is known, current corrugated board-making machines, or corrugating machines, have a main body accommodating three large diameter rollers which are laid side-by-side and in mutual serial engagement relationship. Two of such rollers are corrugated, whereas the third roller is smooth. Paper to be corrugated enters the nip between the corrugated rollers and is partly trained over the middle corrugated roller constituting the corrugating roller proper. On leaving said corrugating roller, the paper workpiece, now corrugated, is joined to a second, smooth paper sheet, called the cover, which is born by the smooth roller.

Prior to this step, while the paper to be corrugated is still on the corrugating roller, a glueing roller applies an amount of glue over the paper surface.

Corrugating machines of that type are highly sophisticated equipments capable of operating at a very high speed: as an example, they may be operated to produce a 200-meter long strip of corrugated board per minute.

Critical to the processing rate and quality of such machines is the construction of the corrugating roller and proper operation of devices located at the corrugating roller and intended for holding the paper being corrugated close against that roller. In fact, at such high rates of operation, the high angular velocity of the corrugating roller subjects the paper to be corrugated and trained over it to a centrifugal action tending to lift the paper radially off, thus separating it from the corrugations or ribs which are to mold it. To prevent this occurrence, which is a cause for serious deterioration of the quality of the corrugated board product and simultaneously avoid lowering the corrugating roller rotational speed, corrugating machines have been equipped with some special devices, which form the specific subject matter of this invention.

Such devices, which are essential to the proper operation of corrugating machines, have undergone several design and construction changes as the engineering and performance of corrugating machines kept evolving.

At the outset, they were in the form of simple semi-circular brass segments, called combs, which were set to skim the crests of the wave pattern on the middle roller and resist separation of the corrugated paper. These semi-circular segments or combs have the disadvantage of hindering to an extent the action of the cited glueing roller, and above all, of being inadequate to keep the paper close against the corrugating rollers as the latter are rotated at a high angular velocity owing to their much limited coverage.

Thus, new and more efficient devices have been developed which hold the paper against the corrugating rollers by drawing it through suction holes and conduits formed in the corrugating roller itself, or drawing it on the opposite side to where the combs were conventionally installed.

Suction drawing through holes and conduits formed through the corrugating roller has in many cases shown to be inadequate, and it seriously interferes with the heating effect applied by the roller to the paper. It should be made clear, in fact, that the corrugating roller is, similarly to the rollers adjoining it, of hollow construction, and through its center cavity, high temperature steam is admitted for heating the corrugating roller and, accordingly, the paper wound around it. It has been found that if the paper is embossed at a high temperature, the corrugations are of improved quality and more stable.

It is apparent that suction drawing, carried out by means of channels extending through the interior of the corrugating roller decreases said heating effect and causes serious distortion of the corrugating roller.

The suction devices which operate on the outside of the corrugating roller, on the opposite side to that where the paper is wound and where combs were conventionally installed, do not suffer from the disadvantage of cooling the roller and inducing distortion therein, since the suction action only affects the surface and is applied on the corrugating cylinder side which is not directly engaged with the paper. However, this technical approach retains the serious disadvantage of a poor effectiveness of the suction which must reach the paper being corrugated. To remedy this problem, circular cutouts have been made in the surface shroud of the middle roller, which are specially thin not to interfere with the embossing of the corrugated paper. Through such cutouts or grooves, the paper is suction drawn and held close against the corrugating roller through an arc of about 180 degrees.

The latter approach has shown to be suitable for processing rates resulting in the attainment of the cited output of 200 meter corrugated paper per minute. At higher rates, and accordingly higher angular velocities of the corrugating roller rotation, the suction effect shows to be inadequate. In view of the constant present trend toward higher processing rates with corrugating machines, attempts have already been made at obviating this deficiency by making the suction effect more effective through the use of small size spouts arranged to be active directly level with the grooves or indentations of the corrugating roller. Thus, the suction effect has been made more directly applied, and it has shown to be theoretically adequate even though the vacuum pumps currently producing it are obliged to operate at the upper limit of their capability. However, with the latter approach, other shortcomings of those devices which hold the corrugated paper down by suction drawing have shown to still exist and be aggravated.

As an example, the danger of clogging the suction outlets by the paper fragments released during the corrugating step is increased. Further, the suction effect becomes heavily dependent on the width dimension of the paper strip being corrugated: any decrease in the width dimension would leave lateral regions of the corrugating roller exposed, thus allowing air freely into the suction ports.

The most serious drawback, connected with the use of suction spouts which act directly level with the circular indentations on the corrugating roller, is foreign, however, to the foregoing and as follows.

In the transition from the inoperative step to the operative one, the corrugating roller expands considerably, both radially and longitudinally, as a consequence of the cited heat applied by the steam flow through its center cavity. This expansion affects said spouts by twisting them and forcing them into contact interaction with the walls of said grooves. This results, inter alia, in premature wear of the spouts and consequent need for applying a constant and careful maintenance to the corrugating machine.

It should be plain from the foregoing that currently available devices for holding corrugated paper are, in many ways, unsatisfactory, and already exploited to the limit of their capabilities.

SUMMARY OF THE INVENTION

In view of the situation outlined above, it is the general aim of this invention to provide a novel device for holding paper close against a corrugating roller, which can substantially obviate the problems described hereinabove.

Within that general aim, it is an important object of the invention to provide such a device which can allow specially high processing rates of corrugating machines without jeopardizing the quality of the resulting corrugated paper.

Another object of the invention is to provide such a device which is unaffected by the expansions undergone by the corrugating roller and can retain its effectiveness irrespective of the width of the paper strip being processed.

It is a further object of the invention to provide such a device which gives substantially no problems from clogging due to fragments separating from the paper being processed, and fits any types of paper, having any substance, and any corrugating machines provided with the cited indentations on the shroud of the corrugating roller.

An additional object of the invention is to provide such a device, with a simple construction and which may be easily made for a low cost by the pertinent industry.

A not unimportant object of the invention is to provide a particular embodiment of said device, whence inherently advantageous technical solutions stem which can represent a technical forward step in the specific industry of board-making machines.

The aforesaid aim and objects are achieved by the device, according to this invention, for holding paper close against a corrugating roller in a corrugated board-making machine, which comprises suction members correlated to a suction control apparatus and connected to said corrugating roller on the unoccupied side thereof by the paper to be held thereagainst, said suction members being communicated to said paper through circular indentations formed on the shroud of said corrugating roller, and is characterized in that said suction members comprise a plurality of suction ports so flattened as to fit at least in part in said indentations and being made rigid with holders carried slidably on parallel bars to said corrugating roller, and in that said holders are guided along said bars by locating elements made rigid with said holders and being inserted into said indentations in substantially direct contact relationship with said corrugating roller.

BRIEF DESCRIPTION OF THE DRAWINGS

Further features and advantages of the invention will be apparent from the following description of a preferred, though not exclusive, embodiment of one such device, as shown, by way of example, and not of limitation in the accompanying drawings, where.

DESCRIPTION OF THE PREFERRED EMBODIMENT

Figure 1:
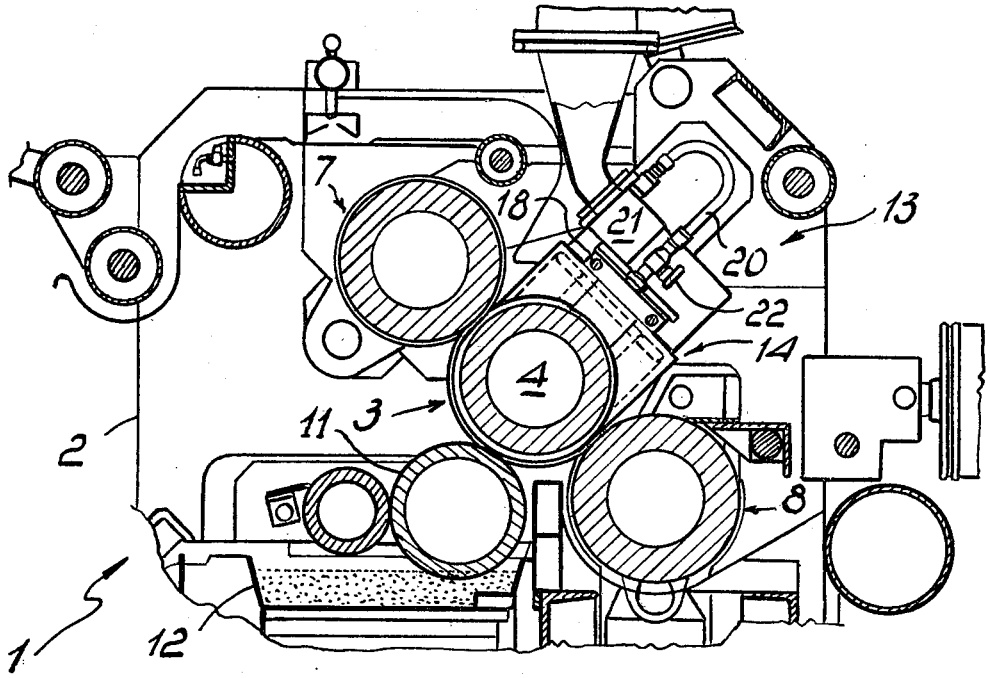
FIG. 1 is a schematic and fragmentary sectional view through a corrugated board-making machine which incorporates the device, according to this invention.

Making reference to the cited drawing figures, a corrugating machine incorporating the device of this invention is generally designated with the reference numeral 1.

Figure 2:
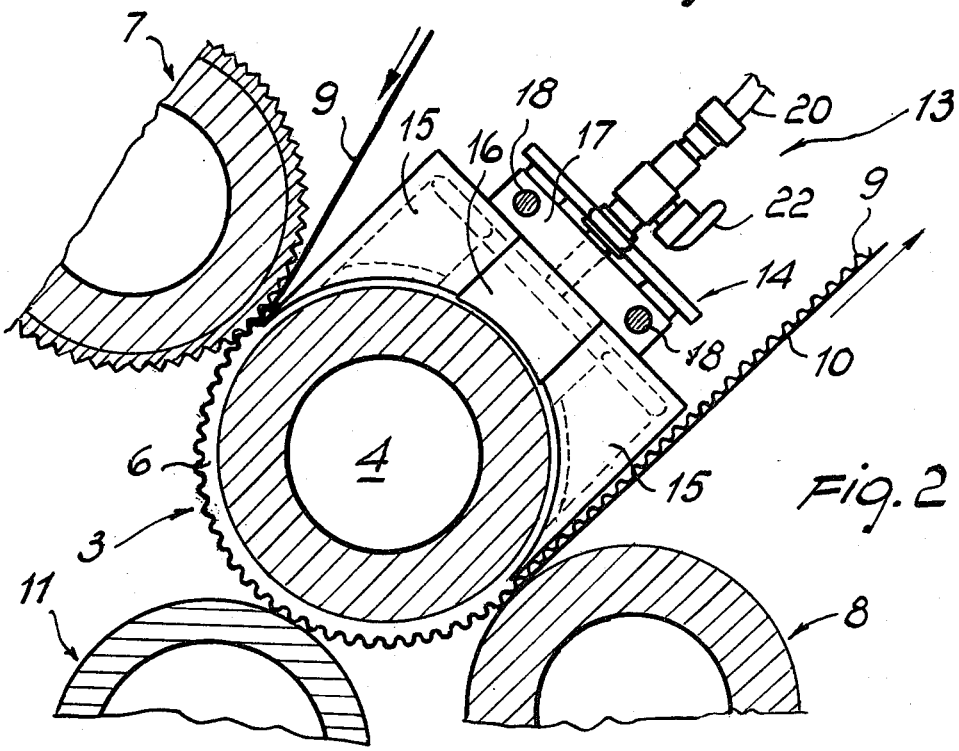
FIG. 2 is a sectional, enlarged view with respect to FIG. 1 of a detail of the corrugating machine incorporating said device.
Figure 3:
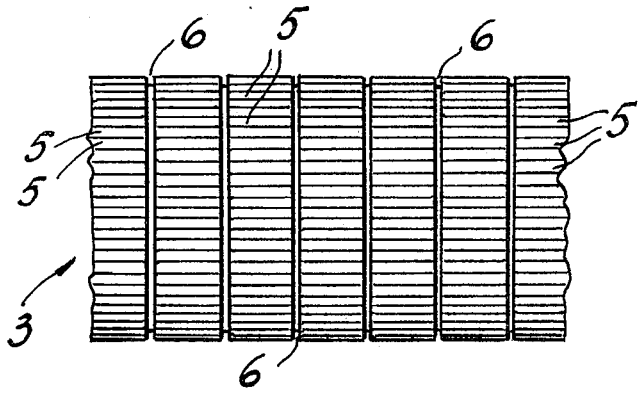
FIG. 3 is a front view of a portion of the corrugating roller whereat the device of this invention is applied.

It comprises, in a manner known per se, a frame 2 supporting a middle roller or corrugating roller 3, whose construction is shown best in FIGS. 2 and 3. It includes, in fact, a center cavity 4 whereinto a flow of high temperature steam is admitted, a surface 5 formed with a number of wave-like ridges or ribs, and annular indentations 6 which extend circularly on the shroud of the corrugating roller 3.

Provided adjacently the corrugating roller 3, are an auxiliary roller 7, also of hollow center construction and corrugated at the surface, and a smooth roller 8 diametrically opposite the auxiliary roller 7. A strip of paper to be corrugated, indicated at 9 in FIG. 2, is inserted in the nip between the corrugating roller 3 and auxiliary roller 7, and after training for substantially 180 degrees around the corrugating roller, leaves it at the smooth roller 8, where it is laminated with a smooth cover 10.

The corrugating roller 3 also contacts a glueing roller 11, partly entering a pan 12 which contains a glue for laminating the paper strip 9 to be corrugated with the cover 10. The glueing roller 11 is operative substantially half way along the path followed by the paper 9 over the corrugating roller 3.

The corrugating machine 1 further includes technical elements which are foreign to this invention and no further described herein.

Figure 4:
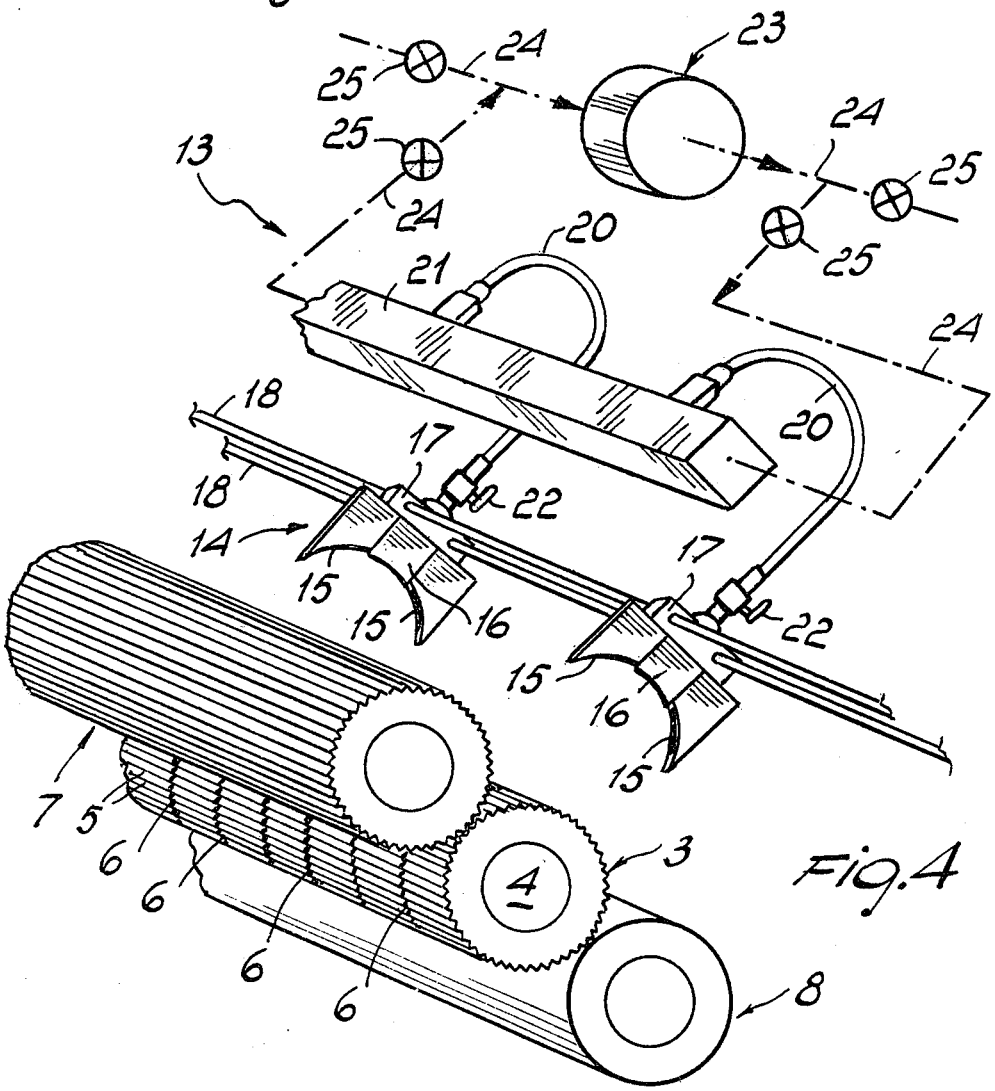
FIG. 4 is a schematic perspective view, partly in exploded representation, of the basic components of the inventive device.

The inventive device is indicated at 13 and is shown, generally and schematically, in FIG. 4.

It is defined, inter alia, by some suction members 14, one for each indentation 6, which comprise, each, one pair of suction ports 15 which are substantially flattened to be insertable into an indentation 6. Inserted between the suction ports 15, in each suction member 14, is a locating element 16 which is inserted to reach the bottom of the respective indentations 6 to define the position both radially and longitudinally of the adjoining suction ports 15. The latter are preferably made of an anti-friction material, and the locating element 16 is preferably formed from a hardened steel.

The combination of the two suction ports 15 and locating element 16 of each suction member 14 define a suction segment matched to the shape of the corrugating roller 3 and extending through about 180 degrees thereof, so as to engage substantially the whole region of each indentation 6 which is left uncovered by the paper being corrugated, as shown particularly in FIG. 2.

With reference, now, to FIG. 4, the suction ports 15 and locating element 16 of each suction member 14 are rigidly supported by a holder 17 slidably engaging with bars 18 extending parallel to the corrugating roller 3.

Figure 5:
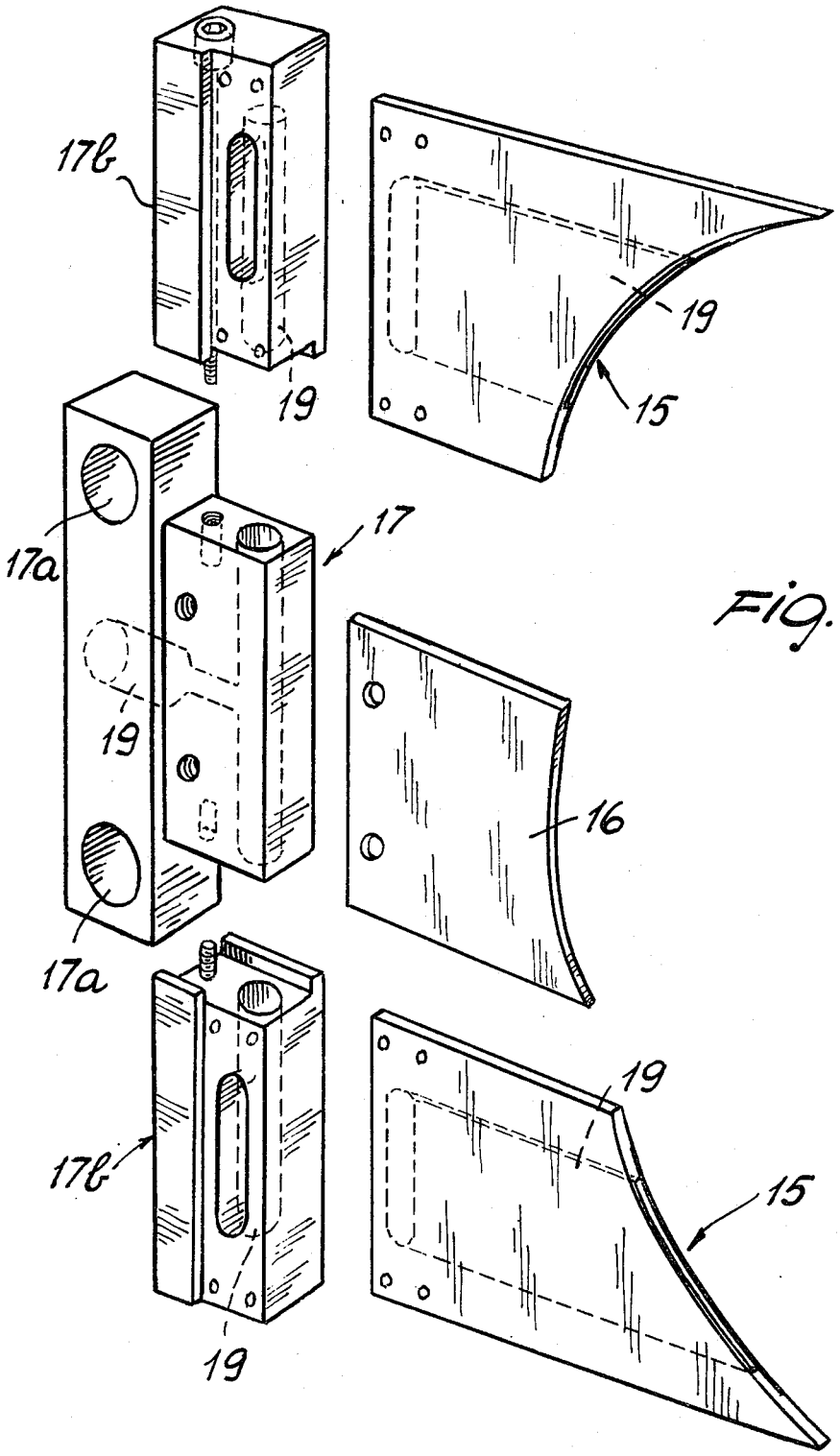
FIG. 5 is an exploded perspective view of the various components of a suction member in the device.

More specifically, the construction of the suction ports 15, locating element 16, and holder 17 is illustrated in FIG. 5.

It may be seen from said figure that the locating element 16 is substantially a blade fastened by means of screws to the holder 17, and that the suction ports 15 are made constructionally rigid with small blocks 18 being a detachable extension of the holder 17. The connection of the blocks 18 to the holder 17 is defined by screw means and interlocking projections.

The holder 17 has a pair of holes 17*a* for its sliding engagement with the bars 18, and suction channels 19 which extend through the blocks 18 as far as the suction ports 15.

As shown in FIGS. 1 and 4, the suction channels 19 formed through the holders 17 are connected to substantially flexible lines 20 inserted into a header 21. Each holder 17 has a respective line 20 of its own and, advantageously, each line 20 has a cock member 22 inserted therein.

FIG. 4, further, shows diagramatically that the header 21 is connected to a suction control apparatus 23 through lines 24 which are constructed to make possible a reversal of the airflow at the suction ports 15. In fact, the lines 24, for example, extend at both ends of the header 21 and comprise valves 25 adapted to controllably cut off the airflow.

Also advantageously provided is that the suction control apparatus 23 should substantially consist of a multistage compressor rather than a vacuum pump.

The operation of the device, according to the invention, is quite apparent from the foregoing, mainly construction-oriented, description.

The holders 17 are free to oscillate along the bars 18 and their movements are guided by the locating elements 16, formed from a high strength material and being inserted substantially to reach the bottom of the indentations 6 on the corrugating roller 3. Thus, it occurs that as the corrugating roller expands under the heat applied to it the suction members 14 can follow without difficulty this expansion movement under the urge from the locating elements 16. The substantially flexible lines 20 also follow the movements of the holders 17 determined by said expansion movements.

Thanks to this technical solution, the device of this invention affords the possibility of arranging the suction ports which surround the corrugating roller 3 and are shaped to match the shape thereof to cover that portion of the indentations 6 which is left free by the paper 9. Thus, the suction effect is enhanced,also on account of the locating element 16 contributing, by substantially covering the region included between the suction ports 15, to appropriately direct the suction airflow.

Further, each suction member 14 may be cut off through its respective cock member 22, thereby it becomes possible to arrange paper strips to be corrugated of any width, without undergoing suction losses.

The suction effect is, moreover, made specially powerful by the provision of the compressor 23 and construction of the lines 24.

Further, the provision of valves 25 enables the airflow, at the suction members 14, to be controllably reversed, thus accomplishing an immediate cleaning thereof of any paper fragments drawn into them.

Thus, the invention achieves its objects.

Tests carried out on a corrugating machine which incorporated the inventive device have shown that, by virtue of the device itself, the corrugating roller can attain very high angular velocities, without causing separation of the paper being corrugated from the corrugation roller.

Furthermore, wear of the suction members has shown to be greatly reduced, and all of the machine tuning and maintenance operations have shown to be quite simple to carry out. Owing to the device construction, the same may be applied on any corrugating roller provided with indentations, irrespective of the depth and number of the indentations.

The invention, as described, is susceptible of many modifications and changes without departing from the scope of the instant inventive concept.

Furthermore, all of the details may be replaced with other, technically equivalent, elements.

In practicing the invention, the materials used, and the shapes and dimensions, may be any selected ones to meet individual requirements.

We claim:

1. A device for holding paper close against a corrugating roller in a corrugated board-making machine, comprising suction members correlated to a suction control apparatus and connected to said corrugating roller on the unoccupied side thereof by the paper to be held thereagainst, said suction members being communicated to said paper through circular indentations formed on the shroud of said corrugating roller, characterized in that said suction members comprise a plurality of suction ports so flattened as to fit, at least in part, in said indentations and being made rigid with holders carried slidably on parallel bars to said corrugating roller, and in that said holders are guided along said bars by locating elements made rigid with said holders and being inserted into said indentations in substantially direct contact relationship with said corrugating roller.

2. A device according to claim 1, characterized in that said locating elements are formed from a high strength material and so arranged and dimensioned, with respect to said holders, as to define the positions of said suction ports both in the longitudinal and radial directions to said corrugating roller.

3. A device according to claim 1, characterized in that said holders are, each, rigid with two of said suction ports and one of said locating element arranged centrally to said suction ports, and in that said two suction ports and said locating element define in combination a suction segment substantially matching the shape of the portion of said indentations which is unoccupied by said paper on said corrugating roller.

4. A device according to claim 1, characterized in that said suction ports are communicated to said holders via suction channels formed through said holders and being connected to substantially flexible lines correlated to said suction control apparatus, and in that each said lines is associated with a cock member operative to cut off the airflow.

5. A device according to claim 1, characterized in that said suction control apparatus is constructed and correlated to said suction ports such as to permit reversal of the airflow in said suction ports.

6. A device according to claim 1, characterized in that said suction control apparatus comprises a multistage compressor.

7. A device according to claim 6, characterized in that said compressor is connected to said suction ports via lines which are cut off by valves operative to control the direction of the airflow relatively to said suction ports.

* * * * *